US008734588B2

(12) United States Patent
Heissler et al.

(10) Patent No.: US 8,734,588 B2
(45) Date of Patent: May 27, 2014

(54) DISHWASHER WITH IMPROVED CLEANING EFFECT

(75) Inventors: Heinz Heissler, Dillingen (DE); Anton Oblinger, Wertingen (DE); Michael Rosenbauer, Reimlingen (DE); Ralf Winkler, New Bern, NC (US); Christian Wolf, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 646 days.

(21) Appl. No.: 12/772,371

(22) Filed: May 3, 2010

(65) Prior Publication Data

US 2011/0265827 A1 Nov. 3, 2011

(51) Int. Cl.
*B08B 3/00* (2006.01)
*B08B 7/04* (2006.01)

(52) U.S. Cl.
USPC ..... 134/18; 134/56 D; 134/57 D; 134/58 D

(58) Field of Classification Search
USPC ..... 134/56 D, 18, 57 D, 58 D
See application file for complete search history.

(56) References Cited

U.S. PATENT DOCUMENTS 5,241,975 A 9/1993 Yanagihara
5,429,146 A * 7/1995 Graf et al. ..... 134/58 D
6,623,565 B2 * 9/2003 Rosenbauer et al. ..... 134/18
6,823,878 B1 * 11/2004 Gadini ..... 134/58 D
2005/0133070 A1 * 6/2005 Vanderroest et al. ..... 134/56 D
2006/0237044 A1 10/2006 Ferguson et al.
2007/0151578 A1 * 7/2007 Cho et al. ..... 134/18
2007/0163626 A1 * 7/2007 Klein ..... 134/56 D
2008/0289655 A1 11/2008 Buerkle et al.

FOREIGN PATENT DOCUMENTS

EP 1040786 A1 * 10/2000 ..... A47L 15/23

OTHER PUBLICATIONS

Engineers Edge, "Pressure Drop Along Pipe Length", all pages, no date.*

* cited by examiner

*Primary Examiner* — Joseph L Perrin
*Assistant Examiner* — Levon J Shahinian
(74) *Attorney, Agent, or Firm* — James E. Howard; Andre Pallapies

(57) ABSTRACT

A dishwasher, wherein a duct system has a function describing a pressure difference in dependence on the rotational speed of the circulating pump and having a lower rotational speed range in which the pressure difference changes at most in proportion to the rotational speed of the circulating pump and an upper rotational speed range in which the pressure difference changes more than in proportion to the rotational speed of the circulating pump; and wherein the control device has a first rinsing program in which the circulating pump is operated at a normal cleaning rotational speed for normal cleaning of the rinsing stock and a second rinsing program in which the circulating pump is operated at an intensive cleaning rotational speed higher than the normal cleaning rotational speed and lying in the upper rotational speed range for intensive cleaning of the rinsing stock.

17 Claims, 3 Drawing Sheets

DISHWASHER WITH IMPROVED CLEANING EFFECT

BACKGROUND OF THE INVENTION

The present invention relates to a dishwasher, particularly a household dishwasher, comprising a control device for carrying out a rinsing process for cleaning rinsing stock on the basis of a rinsing program, a rinsing chamber for receiving the rinsing stock during the rinsing process, a circulating pump for circulating a rinsing liquid present in the rinsing chamber, the rotational speed of the pump being variable by the control device, a first spray element for action on a first region of the rinsing chamber by the circulated rinsing liquid, a second spray element for action on a second region of the rinsing chamber by the circulated rinsing liquid and a duct system for conducting the circulated rinsing liquid from the circulating pump to the first spray element and the second spray element, the duct system having a first branch conducting the rinsing liquid to the first spray element and a second branch conducting the rinsing liquid to the second spray element.

A dishwasher of that kind is known from practice. In the known dishwasher it is not always possible to optimally match the cleaning action to the loading of the dishwasher.

BRIEF SUMMARY OF THE INVENTION

The object of the present invention is to provide a dishwasher, particularly household dishwasher, in which the cleaning action can be better matched to the load.

In the case of a dishwasher of the kind stated in the introduction the object is fulfilled in that the duct system is so constructed that a function describing a pressure difference, which is defined as a pressure of the rinsing liquid in the second spray element less a pressure of the rinsing liquid in the first spray element, in dependence on the rotational speed of the circulating pump has a lower rotational speed range in which the pressure difference changes at most in proportion to the rotational speed of the circulating pump and an upper rotational speed range in which the pressure difference changes more than in proportion to the rotational speed of the circulating pump, wherein the control device has a first rinsing program in which the circulating pump is operated at a normal cleaning rotational speed for normal cleaning of the rinsing stock and a second rinsing program in which the circulating pump is operated at an intensive cleaning rotational speed lying higher than the normal cleaning rotational speed and in the upper rotational speed range for intensive cleaning of the rinsing stock.

The dishwasher according to the invention comprises a control device for automatic execution of operating sequences of the dishwasher. The control device can for that purpose be constructed as a so-called sequence control, particularly as an electronic sequence control.

Rinsing programs for executing or controlling a rinsing procedure, also called rinsing process, for the rinsing of rinsing stock, particularly for the rinsing of dishes, are filed in the control device, one of which can be selected and started on each occasion by the user. It is thereby basically possible to adapt the course of a rinsing process to, in particular, the load amount, the kind of load, the degree of contamination of the rinsing stock and/or to the desired duration of the rinsing process.

The filed rinsing programs can preferably be such that the respective rinsing process which they control comprises at least one prewash process for preliminary cleaning of rinsing stock, at least one cleaning process for basic cleaning of rinsing stock, at least one intermediate rinsing process for removal of contaminated rinsing liquid from the rinsing stock, at least one clear rinsing process for avoidance of spots on the rinsing stock and/or for preparation of a drying step, and/or at least one drying process for drying the rinsing stock. Prewash process, cleaning process, intermediate rinsing process and clear rinsing process are termed water-conducting part rinsing processes in the following, since during performance thereof the rinsing stock introduced into the rinsing chamber is treated by a rinsing liquid. Use of rinsing liquid is usually not provided during the drying process.

Treatment of the rinsing stock by rinsing liquid is in that case carried out in a substantially closed rinsing chamber, particularly a rinsing container, of the dishwasher. Associated with the rinsing chamber is a feed valve enabling entry of rinsing liquid into the rinsing chamber. In that case the feed valve is openable and closable by the control device so as to influence the feed of rinsing liquid.

By "rinsing liquid" there is understood here a liquid provided for the purpose of being applied to the rinsing stock in order to clean this and/or treat it in another manner. In particular, the rinsing liquid can also be provided for, for example, heating of rinsing stock, which is usual, for example, during a clear rinsing step.

The rinsing liquid entering the rinsing chamber by way of the feed valve is usually fresh water. In that case the rinsing liquid in the rinsing chamber can be laden, depending on the respective operating phase of the dishwasher, with cleaning agents, cleaning additives such as, for example, clear rinsing agent, and/or with dirt detached from the rinsing stock. However, cases are also conceivable in which already laden water is introduced as rinsing liquid into the rinsing chamber by way of the feed valve.

Moreover, a circulating pump, which typically is electrically driven, for circulating the introduced rinsing liquid is associated with the rinsing chamber and enables the rinsing liquid, which is present in the rinsing chamber, to be removed from, for example, a collecting device for rinsing liquid and applied to the rinsing stock by way of a spray system associated with the rinsing chamber. The rotational speed of the circulating pump can in that case be controllable and/or regulable in variable manner by the control device of the dishwasher.

The circulating pump can comprise a brushless electric motor. The brushless electric motor can be constructed as, in particular, a permanent magnet motor. A brushless permanent magnet motor of that kind can be constructed as, for example, a brushless direct current motor, also termed BLDC motor, or as a brushless alternating current motor, also termed BLAC motor. The rotor of the motor in that case comprises at least one permanent magnet, whereagainst the stator has several electromagnets. The electromagnets are commutated by way of an electronic drive control system, particularly by way of a frequency converter. By comparison with other possible motor concepts, both the rotational direction and the rotational speed of the motor can thereby be controlled in simple manner. It is possible through operation of the motor in just one rotational direction to optimise the water-conducting parts of the circulating pump in terms of flow. A high conveying performance for low use of energy thereby results. Moreover, the brushless permanent magnet motor can be constructed as a wet-running rotor so that costly sealing measures are eliminated.

The spray system comprises at least one spray element for acting on a first region of the rinsing chamber with the circulated rinsing liquid and a second spray element for acting on a second region of the rinsing chamber with the circulated rinsing liquid. Not only the first spray element, but also the second spray element each have at least one outlet for the rinsing liquid, wherein the outlet can be constructed as, for example, a nozzle. In order to be able to load the first spray element and the second spray element with the rinsing liquid, a duct system for simultaneous guidance of the circulated rinsing liquid from the circulating pump to the first spray element and the to second spray element is provided. The duct system in that case comprises a first branch which conducts the rinsing liquid preferably exclusively to the first spray element and a second branch which conducts the rinsing liquid preferably exclusively to the second spray element.

In the dishwasher according to the invention the duct system is constructed in such a manner that a function describing a pressure difference produced by the circulating pump, the difference being defined as a pressure of the rinsing liquid in the second spray element less a pressure of the rinsing liquid in the first spray element, in dependence on the rotational speed of the circulating pump has a lower rotational speed in which the pressure difference changes at most proportionally to the rotational speed of the circulating pump and an upper rotational speed in which the pressure difference changes more than proportionally to the rotational speed of the circulating pump.

This means that in the lower rotational speed range in the case of a change in the rotational speed by a specific percentage there is at most a change in the pressure difference by approximately the same percentage. By contrast, in the upper rotational speed range in the case of a change in the rotational speed by a specific percentage there is a change, which lies above the percentage of the respective rotational speed increase, in the pressure difference.

In that regard the control device has a first rinsing program in which the circulating pump is operated at a normal cleaning rotational speed for normal cleaning of the rinsing stock and a second rinsing program in which the circulating pump is operated at an intensive cleaning rotational speed higher than the normal cleaning rotational speed and lying in the upper rotational speed range for intensive cleaning of the rinsing stock.

In the second rinsing program the cleaning action is now higher than in the first rinsing program, since the mechanical stripping action of the rinsing liquid increases due to the higher rotational speed of the circulating pump and due to the rise, which results therefrom, in the pressure of the rinsing liquid in the two spray elements.

According to an advantageous constructional form of the duct system, however, the pressure of the rinsing liquid increases in the second rinsing program, in particular more strongly in the second spray element than in the first spray element. An especially intensive cleaning action thereby arises in the second region of the rinsing chamber, which is acted on with rinsing liquid by the second spray element, so an intensive cleaning region which can be used particularly for cleaning strongly contaminated rinsing stock, for example cooking vessels, is created. Due to the lower rise of the pressure of the rinsing liquid in the first spray element there simultaneously arises in the first region of the rinsing chamber—which is acted on with rinsing liquid by the first spray element—a less intensive mechanical loading of the rinsing stock, so that a gentle cleaning region which can be used particularly for cleaning sensitive rinsing stock, for example glasses, is created.

It is thus possible, through selection of the second rinsing program to simultaneously clean strongly contaminated dishes sufficiently intensively and sensitive rinsing stock sufficiently gently. In that case dirt residues at the strongly contaminated rinsing stock are avoided just as is damage due to excessive mechanical action on sensitive rinsing stock.

An optimal matching of the cleaning action to the loading of the dishwasher can be effected by simple fixing of the intensive cleaning rotational speed. Additional actuators such as valves, water switching points and the like, which could be associated with the duct system for influencing the transport of the rinsing liquid, are not necessary in the dishwasher according to the invention. The dishwasher according to the invention is thus low-maintenance, less susceptible to fault and capable of economic manufacture.

According to an advantageous development of the invention the normal cleaning rotational speed lies in the lower rotational speed range. It can thus be achieved in the first rinsing program that the cleaning action in the first region of the rinsing chamber and the cleaning action in the second region of the rinsing chamber approximate one another due to a small pressure difference in the two spray elements, which is of advantage particularly when rinsing stock of comparable kind and degree of contamination are to be cleaned in the first region and the second region.

According to an advantageous development of the invention the pressure difference in operation of the dishwasher is set exclusively by the control device by means of variation of the rotational speed of the circulating pump. A dishwasher of that kind can be of particularly simple construction and thus reliable and able to be produced economically. In particular, it does not need throttle valves or water-switching points in the area of the duct system.

According to an advantageous development of the invention a pressure loss of the rinsing liquid due to leakage losses is higher in the first branch than in the second branch. The over-proportional increase in the pressure difference in the upper rotational speed range can thereby be produced in simple manner. By "leakage losses" there is that case understood a proportion of the rinsing liquid which due to leakages issues from the respective branch before it reaches the corresponding spray element.

According to an advantageous development of the invention the first spray element is a rotatable spray arm which is arranged at a rotary coupling having a leakage point. In this manner leakage losses in the first branch can be increased in particularly simple manner.

According to an advantageous development of the invention a pressure loss of the rinsing liquid due to friction is higher in the first branch than in the second branch. The over-proportional increase in the pressure difference in the upper rotational speed range can thereby be produced or amplified in simple manner.

According to an advantageous development of the invention the first branch comprises a section having a constriction. The friction in the first branch can be selectively influenced by means of the constriction so as to produce the desired plot of the function. By "constriction" there is understood in that regard a reduction in the cross-section, which can be flowed through, of the respective section of the duct system.

According to an advantageous development of the invention the first branch has a longer length than the second branch. A higher friction in the first branch than in the second branch can thereby be achieved in simple manner. In particular, a lower dynamic pressure for the first spray element than for the second spray element can be produced by the greater length of the first branch by comparison with the second branch.

According to an advantageous development of the invention a dishes basket for reception of pans, pots, plates and/or items of cutlery can be arranged in the second region of the rinsing chamber. It is thereby possible in simple manner to intensively clean rinsing stock which is typically strongly contaminated, but less sensitive. The second region can be formed by, in particular, the accommodation region of the lower dishes basket of a dishwasher.

According to an advantageous development of the invention a dishes basket for reception of glasses and/or cups is arranged in the first region of the rinsing chamber. Rinsing stock which is usually less contaminated, but more sensitive, can thus be carefully cleaned in simple manner. The first region can be formed by, in particular, the accommodation region of the upper dishes basket of a dishwasher.

According to an advantageous development of the invention the intensive cleaning rotational speed is at least 2.5%, preferably at least 5%, particularly preferably at least 10%, higher than the normal cleaning rotational speed. An appropriate increase in the cleaning action can thereby be achieved.

According to an advantageous development of the invention a pressure difference at the intensive cleaning rotational speed is at least 5%, preferably at least 10%, particularly preferably at least 20%, higher than a pressure difference at the normal cleaning rotational speed. The cleaning action can thereby be appropriately increased.

Moreover, the invention relates to a method of operating a dishwasher, particularly according to any one of the preceding claims, comprising a rinsing chamber for receiving the rinsing stock during the rinsing process, a circulating pump for circulating a rinsing liquid present in the rinsing chamber, the rotational speed of the pump being variable by the control device, a first spray element for action on a first region of the rinsing chamber by the circulated rinsing liquid, a second spray element for action on a second region of the rinsing chamber by the circulated rinsing liquid and a duct system for conducting the circulated rinsing liquid from the circulating pump to the first spray element and the second spray element, the duct system having a first branch conducting the rinsing liquid to the first spray element and a second branch conducting the rinsing liquid to the second spray element.

In the method according to the invention it is provided that the duct system is so constructed that a function describing a pressure difference, which is defined as a pressure of the rinsing liquid in the second spray element less a pressure of the rinsing liquid in the first spray element, in dependence on the rotational speed of the circulating pump has a lower rotational speed range in which the pressure difference changes at most in proportion to the rotational speed of the circulating pump and an upper rotational speed range in which the pressure difference changes more than in proportion to the rotational speed of the circulating pump, wherein either a first operating mode in which the circulating pump is operated at a normal cleaning rotational speed for normal cleaning of the rinsing stock or a second operating mode in which the circulating pump is operated at an intensive cleaning rotational speed, which is higher than the normal cleaning rotational speed and lies in the upper rotational speed range, for intensive cleaning of the rinsing stock is selected at the control device.

The method according to the invention enables a simple, quick and reliable matching of a rinsing process to the load of a dishwasher and is distinguished by low demands on the constructional format of the dishwasher.

Other advantageous constructions and/or developments of the invention are reflected in the claims.

The advantageous developments of the invention reflected in the dependent claims and/or explained in the foregoing can be provided individually or in any combination with one another.

BRIEF DESCRIPTION OF THE DRAWINGS

The invention and its developments as well as the advantages thereof are explained in more detail in the following by way of drawings, in which.

DETAILED DESCRIPTION OF EXEMPLARY EMBODIMENTS OF THE PRESENT INVENTION

Figure 1:
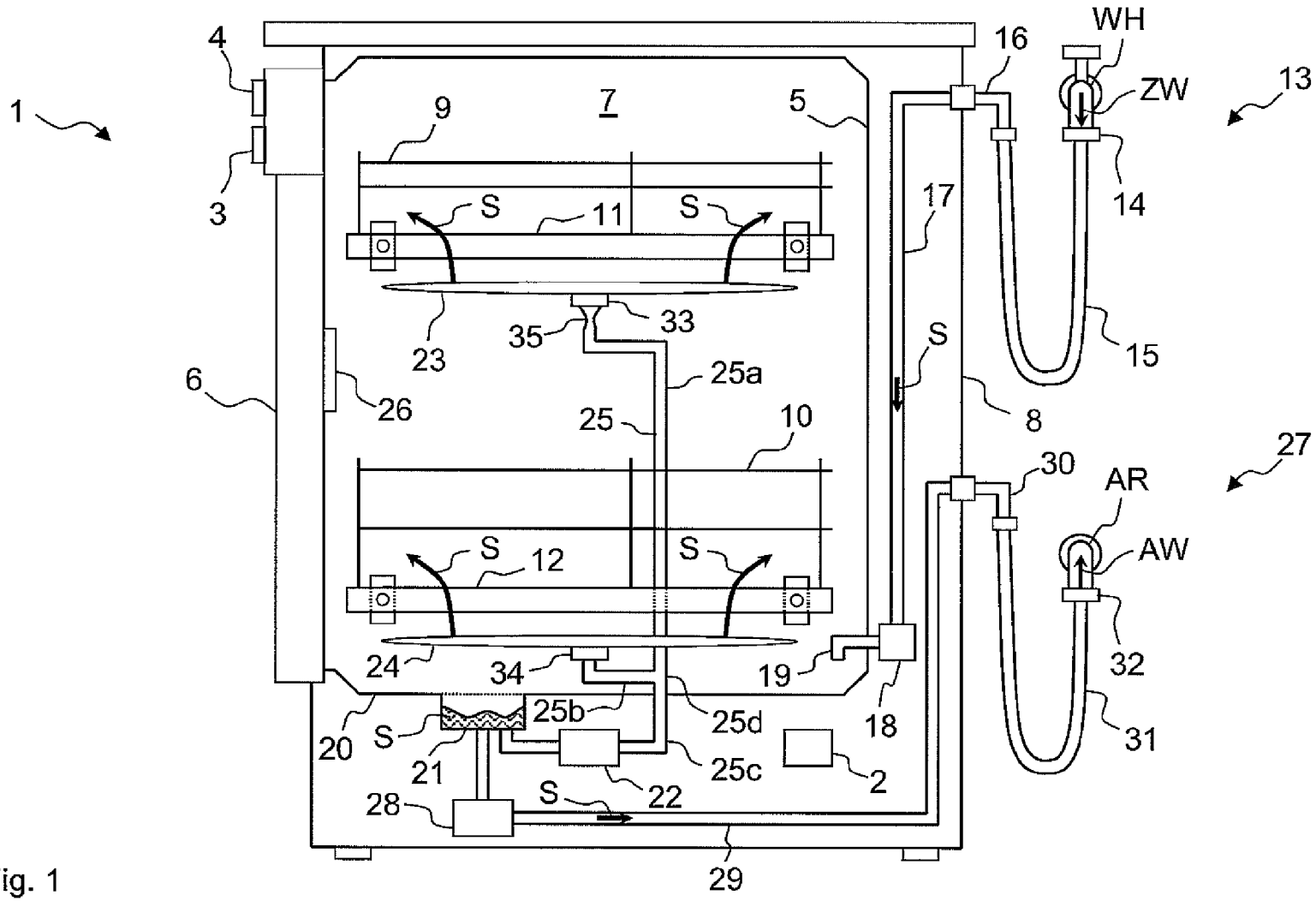
FIG. 1 shows an exemplifying embodiment of a household dishwasher according to the invention, in a schematic side view.

In the following figures, parts corresponding with one another are provided with the same reference numerals. In that case, only those components of a dishwasher which are required for understanding of the invention are provided with reference numerals and explained. It will be obvious that the dishwasher according to the invention can comprise further parts and subassemblies.

FIG. 1 shows an advantageous exemplifying embodiment of a household dishwasher 1 according to the invention in a schematic side view. The dishwasher 1 comprises a control device 2 in which rinsing programs for controlling a rinsing process for the rinsing of rinsing stock, particularly dishes, are filed. Advantageously, in that case a plurality of rinsing programs is stored so that through selection of a suitable rinsing program the course of a rinsing process controlled by the control device 2 can be matched to, for example, the load quantity, load kind, degree of contamination of the rinsing stock and/or the desired duration of the rinsing process.

Associated with the control device 2 is an operating device 3 which allows a user of the dishwasher 1 to call up and thereby start one of the rinsing programs. In addition, an output device 4 enabling output of reports to the user is associated with the control device. The output device 4 can comprise indicating lamps, light-emitting diodes, an alphanumeric display and/or a graphical display for the issue of optical reports. In addition, or independently thereof the output device 4 can optionally be constructed for output of acoustic reports and comprise for that purpose, for example, a buzzer, a loudspeaker and/or the like.

The dishwasher 1 further comprises a rinsing container 5 which is closable by a door 6 so that a closed rinsing chamber 7 for the rinsing of rinsing stock arises. The rinsing container 5 can in a given case be arranged in the interior of a housing 5 of the dishwasher 1. The housing 8 is not necessary in the case of a built-in dishwasher and can be partly or entirely omitted. The door 6 is shown in its closed setting in FIG. 1. The door 6 can be brought, by pivotation about an axis arranged perpendicularly to the plane of the drawing, into an open setting in which it is oriented substantially horizontally and enables introduction and removal of rinsing stock. In the exemplifying embodiment shown in FIG. 1 the operating device 3 is arranged in user-friendly manner at an upper section of the door 6. The output device 4 is similarly arranged at the upper section of the door 6 so that optical reports are readily visible and acoustic reports readily audible. However, in principle it is possible to arrange the operating device 3 and/or the output device 4 at another location.

The control device 2 is, for example, accommodated in a base subassembly below the rinsing container. However, it is also possible to arrange the control device 3 at another location in the dishwasher 1 such as, for example, in the base subassembly thereof below the rinsing container. The control device 2 could optionally also be of decentral construction, by which it is understood that it comprises physically separated components which are so connected by way of communications means that they can co-operate.

According to an alternative variant of embodiment the control device 2 or at least one of its decentral components can be positioned in the door 6 so that the required signal connection lines between the operating device 3, the output device 4 and the control device 3 can be kept short.

The dishwasher 1 has, for the positioning of dishes, an upper dishes basket 9 and a lower dishes basket 10. The upper dishes basket 9 is in that case arranged on extension rails 11, which are respectively fastened to opposite side walls, which extend in the depth direction of the rinsing container, of the rinsing container 5. When the door 6 is open the dishes basket 9 can be moved out of the rinsing container 5 by means of the extension rails 11, which facilitates loading and unloading of the upper dishes basket 9. The lower dishes basket 10 is in analogous manner arranged at extension rails 12. If the door 6 is pivoted out horizontally, the lower dishes basket 10 can be moved out forwardly thereon. It then functions as a form of support table for the other dishes basket.

The rinsing program or programs filed in the control device 2 can provide several respective part rinsing processes, for example in this sequence: at least one prewash process, at least one cleaning process, at least one intermediate rinsing process, at least one clear rinsing process and/or at least one drying process. In that case, prewash process, cleaning process, intermediate rinsing process and clear rinsing process are termed water-conducting part rinsing processes, since during performance thereof the rinsing stock positioned in the rinsing chamber 7 is treated with a rinsing liquid S. During the drying process, treatment of the rinsing stock with rinsing liquid S is usually not provided.

As rinsing liquid S for treatment of the rinsing stock use is made in the exemplifying embodiment of fresh water or feed water ZW which is extracted from an external water supply device WH, particularly a drinking water supply mains, and introduced into the rinsing chamber 7. In that case, typically at the beginning of each water-conducting part rinsing process a rinsing liquid S formed from fresh feed water ZW is introduced, which then at the end of the respective part rinsing process is delivered to an external waste water disposal device AR as waste water AW. However, it is also possible to store a rinsing liquid S of a part rinsing process in a storage container (not shown) and reintroduce it into the rinsing chamber 7 in a later part rinsing process.

The dishwasher 1 of FIG. 1 in that case comprises a water feed device 13 provided for connection with the external water supply device WH. As in FIG. 1, the external water supply device WH can be a water cock of a building water installation which provides feed water ZW standing under pressure. The water feed device 13 comprises a connecting member 14 provided for connection with the water cock WH. The connection can be effected by way of, for example, a threaded arrangement, a bayonet arrangement or the like. A connecting hose 15 preferably of flexible construction is provided downstream of the connecting member 14. The downstream end of the connecting hose 15 is connected with a connecting member 16 fixed at the housing.

Provided downstream of the connecting member 16 fixed at the housing is a supply line 17 which is connected with an inlet side of a feed valve 18 switchable by means of the control device 2. An outlet side of the feed valve 18 is in turn connected with a liquid inlet 19 of the rinsing chamber 7. It is possible in this manner to conduct feed water ZW as rinsing liquid S into the interior of the rinsing chamber 7 of the dishwasher 1 by means of the water feed device 13. The feed valve 18 can in that case be constructed as a switchable magnetic valve which has merely an open setting and a closed setting. A water preparation installation (not shown), for example a softening installation, can be provided in the supply line 17.

Instead of or in addition to the feed valve 18 at the appliance it is also possible to provide between the connecting member 14 and the water cock WH an external feed valve, particularly a so-called Aqua-Stop valve, which is preferably switchable, particularly blockable and openable, by means of the control device. This Aqua-Stop valve is preferably directly coupled to the water cock and forms the inlet connecting part of the connecting hose 15.

The rinsing liquid S passing by way of the liquid inlet 19 into the rinsing chamber 7 passes by way of its gravitational force into a collecting device 21, which is formed at a base 20 of the rinsing container 5 and which can preferably be constructed as a collecting pot 21. An inlet side of a circulating pump 22 is in that case in liquid-conductive connection with the collecting pot 21. In the exemplifying embodiment the circulating pump 22 comprises a brushless alternating current motor, also termed BLAC motor. However, in principle other motor concepts, particularly a brushless direct current motor, i.e. a so-called BLDC motor, would also be conceivable.

In addition, an outlet side of the circulating pump 22 is connected with a spray device 23, 24, which makes it possible to act by rinsing liquid S on rising stock introduced into the rinsing chamber 7. In the exemplifying embodiment of FIG. 1 the spray device 23, 24 comprises a first spray element 23 for action on a first region of the rinsing chamber 7 with the circulated rinsing liquid S as well as a second spray element 24 for action on a second region of the rinsing chamber 7 with the circulated rinsing liquid S. In that case the first spray element 23 is constructed as an upper rotatable spray 23 which acts by rinsing liquid S substantially on that region of the rinsing chamber 7 in which the upper dishes basket 9 is located. In addition, the second spray arm 24 is constructed as a lower rotatable spray arm 24 which acts by rinsing liquid S substantially on that region of the rinsing chamber 7 in which the lower dishes basket 10 is located. However, alternatively or additionally, stationary spray elements could also be provided.

Provided for conducting the circulated rinsing liquid S from the circulating pump 22 to the first spray element 23 and the second spray element 24 is a duct system 25 which comprises a first branch 25*a* conducting the rinsing liquid S to the first spray element 23 and a second branch 25*b* conducting the rinsing liquid S to the second spray element 24. The upstream ends of the first branch 25*a* and the second branch 25*b* are connected with a common branch 25*c* of the duct system 25, by way of which the rinsing liquid S led to the first spray element 23 and to the second spray element 24 is conducted. In that case a branch 25*d* is provided for connection of the first branch 25*a* and the second branch 25*b* with the common branch 25*c* at the downstream end thereof. The first branch 25*a* and/or the second branch 25*b* could alternatively be directly connected with the circulating pump 22.

In addition, the dishwasher 1 in conventional manner comprises a metering device making it possible to mix rinsing liquid S, which is introduced into the rinsing chamber 7, with cleaning agents and/or cleaning additives in order to improve the cleaning action and/or the drying action of a rinsing process.

Moreover, the dishwasher 1 shown in FIG. 1 comprises an outflow device 27 serving the purpose of pumping rinsing liquid S, which is no longer needed, outwardly from the rinsing chamber 7 as waste water AW. The outflow device 27 comprises a solution pump 28, the inlet side is connected with the collecting pot 21. The outlet side of the solution pump 28, thereagainst, is connected with a connecting duct 29, the downstream end of which is connected with a connection 30, which is fixed relative to the housing, of the dishwasher 1.

The solution pump 28 has, just like the circulating pump 22, a brushless alternating current motor, also termed BLAC motor. However, other motor concepts, particularly a brushless direct current motor, would also be conceivable here.

A waste water hose 31 of flexible construction is fastened to an outlet of the connection 30 fixed relative to the housing. Arranged at the downstream end of the waste water hose 31 is a connecting member 32 provided for the purpose of connecting the outflow device 27 with a waste water disposal device AR. The waste water disposal device AR can be a waste water pipe of a building water installation. The connection between the connecting member 32 and to the waste water pipe can be constructed as a screw connection, bayonet connection, plug connection or the like.

In the dishwasher 1 of the exemplifying embodiment the duct system 25 is so constructed that a function describing a pressure difference, which is generated by the circulating pump 22 and which is defined as a pressure of the rinsing liquid S in the second spray element 24 less a pressure of the rinsing liquid S in the first spray element 23, in dependence on the rotational speed of the circulating pump 22 has a lower rotational speed range in which the pressure difference changes at most proportionally to the rotational speed of the circulating pump and an upper rotational speed in which the pressure difference changes more than proportionally to the rotational speed of the circulating pump 22.

This means that in the lower rotational speed range on a change in the rotational speed by a specific percentage value at most a change in the pressure difference by the same percentage value results. Thereagainst, in the upper rotational speed range on a change in the rotational speed by a specific percentage value a change in the pressure difference lying above the percentage value of the respective rotational speed change arises.

In order to have the effect that the function describing the pressure difference in dependence on the rotational speed of the circulating pump sets itself as intended the first branch 25*a* is so constructed that there the leakage losses are higher than in the second branch 25*b*. The over-proportional increase in the pressure difference in the upper rotational speed range can thereby be produced in simple manner. In the exemplifying embodiment the first spray element 23 is a rotatable spray arm arranged in a rotary coupling 33, which is arranged in the first branch 25*a* and has a leakage point. Thereagainst, the second spray element 24, which is a rotatable spray arm, is arranged at a rotary coupling 34 which is arranged in the second branch 25*b* and has no such leakage point. It is thereby ensured in simple manner that the leakage losses in the first branch 25*a* are higher than in the second branch 25*b*.

Moreover, in a given case it can be advantageous if in addition or independently thereof it is provided for setting the function that a pressure loss of the spray liquid S is higher in the first branch 25*a* than in the second branch 25*b* due to friction. The over-proportional increase in the pressure difference in the upper rotational speed range can thereby be reduced or amplified in simple manner.

For that purpose the first branch 25*a* can in advantageous manner comprise a section having a constriction 35. By means of the constriction 35 the friction in the first branch 25*a* can be selectively influenced so as to produce the desired plot of the function. By "constriction" there is understood in that case a reduction in the cross-section, which can be flowed through, of the respective section of the duct system 25.

In addition, the first branch 25*a* can have a longer length than the second branch 25*b*. A higher friction in the first branch 25*a* than in the second branch 25*b* can thereby be achieved in simple manner.

In the exemplifying embodiment the control device 2 comprises a first rinsing program in which the circulating pump 22 is operated at a normal cleaning rotational speed for normal cleaning of the rinsing stock and a second rinsing program in which the circulating pump is operated at an intensive cleaning rotational speed, which is higher than the normal cleaning rotational speed and lies in the upper rotational speed range, for intensive cleaning of the rinsing stock.

In the second rinsing program the cleaning action is now higher than in the first rinsing program, since the mechanical stripping action of the rinsing liquid S increases due to the higher rotational speed of the circulating pump 22 and the increase, which results therefrom, in the pressure of the rinsing liquid 2 in the two spray elements 23, 24.

However, due to the constructional form of the duct system 25 the pressure of the rinsing liquid S in the second spray element 24 rises more strongly than in the first spray element 23 in the second rinsing program. A particularly intensive cleaning action thereby arises in the second region of the rinsing chamber 7, which is acted on by the second spray element 24 with rinsing liquid S, thus here in the lower dishes basket 10 constructed for reception of pans, pots, plates and/or items of cutlery, so that an intensive cleaning region is produced which can be used particularly for cleaning of strongly contaminated rinsing stock, for example cooking vessels.

Due to the lower rise in the pressure of the rinsing liquid S in the first spray element 23 a less intensive mechanical loading of the rinsing stock arises at the same time in the first region of the rinsing chamber 7, which is acted on by the first spray element 23 with rinsing liquid S, thus here in the upper dishes basket 9 constructed for reception of glasses and/or cups, so that a gentle cleaning region is produced which can be used particularly for cleaning of sensitive rinsing stock, for example glasses.

It is thus possible, through selection of the second rinsing program to simultaneously clean strongly contaminated dishes sufficiently intensively and sensitive rinsing stock sufficiently gently. In that case, dirt residues at the strongly contaminated rinsing stock are avoided just as is damage due to excessive mechanical action on sensitive rinsing stock.

In the first rinsing program, thereagainst, rinsing stock of comparable kind and contamination can be optimally cleaned in the two dishes baskets 9, 10. The normal cleaning rotational speed can then lie particularly in the lower rotational speed range. It can thereby be achieved in the first rinsing program that the cleaning action in the first region of the rinsing chamber 7 and the cleaning action in the second region of the rinsing chamber 7 approximate one another due to a small pressure difference in the two spray elements.

Figure 2:
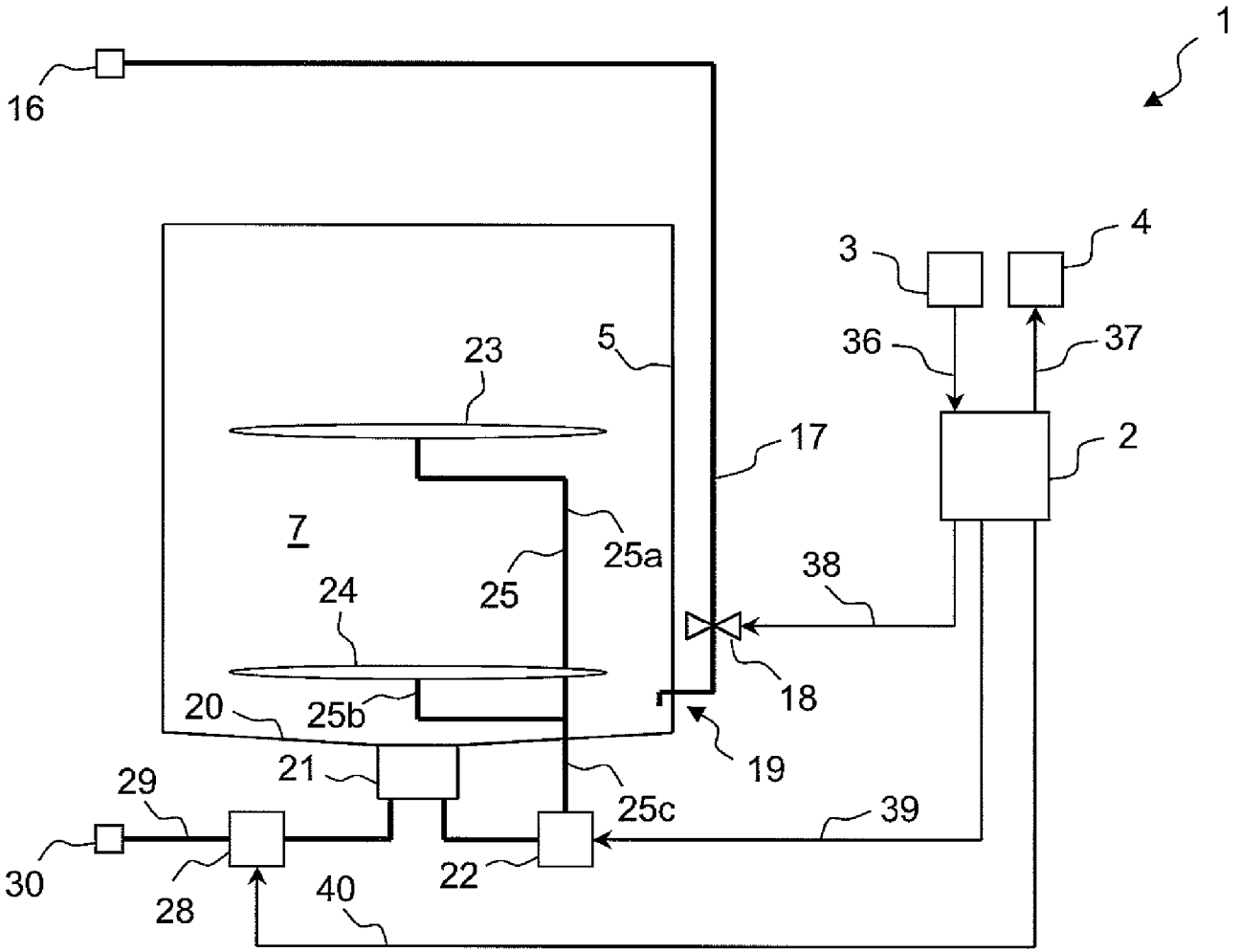
FIG. 2 shows a further illustration of the dishwasher of FIG. 1.

FIG. 2 shows a block illustration of the domestic dishwasher 1 of FIG. 1, wherein, in particular, the control and communications concept is illustrated. Provided in the exemplifying embodiment is a signal line 36 which so connects the operating device 3 with the control device 2 that operating commands of a user are transmissible by the operating device 3 to the control device 2. Moreover, a signal line 37 is provided which connects the control device 2 with the output device 4 so that data provided by the control device 2 can be transmitted to the output device 4 and issued there to the user.

Moreover, a control line 38 is provided which so connects the control device 2 with the switchable feed valve 18 that the feed valve 18 can be closed or opened by the control device 2. In this manner filling of rinsing liquid S into the rinsing chamber 7 can be controlled by to the control device 2.

A supply line 39 connects the control device 2 with the circulating pump 22. The circulating pump 22 is thereby also switchable by the control device 2. The control device 2 is in that case constructed for switching on and switching off the circulating pump 22 and, in particular, for controlling and/or regulating the rotational speed of the circulating pump 22.

In addition, a supply line 40 is provided which connects the control device 2 with the solution pump 28 so that the solution pump 28 is also switchable by the control device 2, in particular switchable off and on. In addition, the rotational speed of the solution pump 28 can be controllable and/or regulable by the control device 2.

An optimal adaptation of the cleaning action to the load of the dishwasher 1 is carried out in the exemplifying embodiment exclusively by presetting the rotational speed of the circulating pump 22 in dependence on the selected rinsing program. Additional actuators, such as valves, water switching points and the like which could be associated with the duct system 25 for influencing the transport of the rinsing liquid S, are not provided in the dishwasher 1 of the exemplifying embodiment and are not needed for the desired change in pressure difference. The exemplifying dishwasher 1 is thus low in maintenance, less susceptible to disturbance and can be produced economically.

Figure 3:
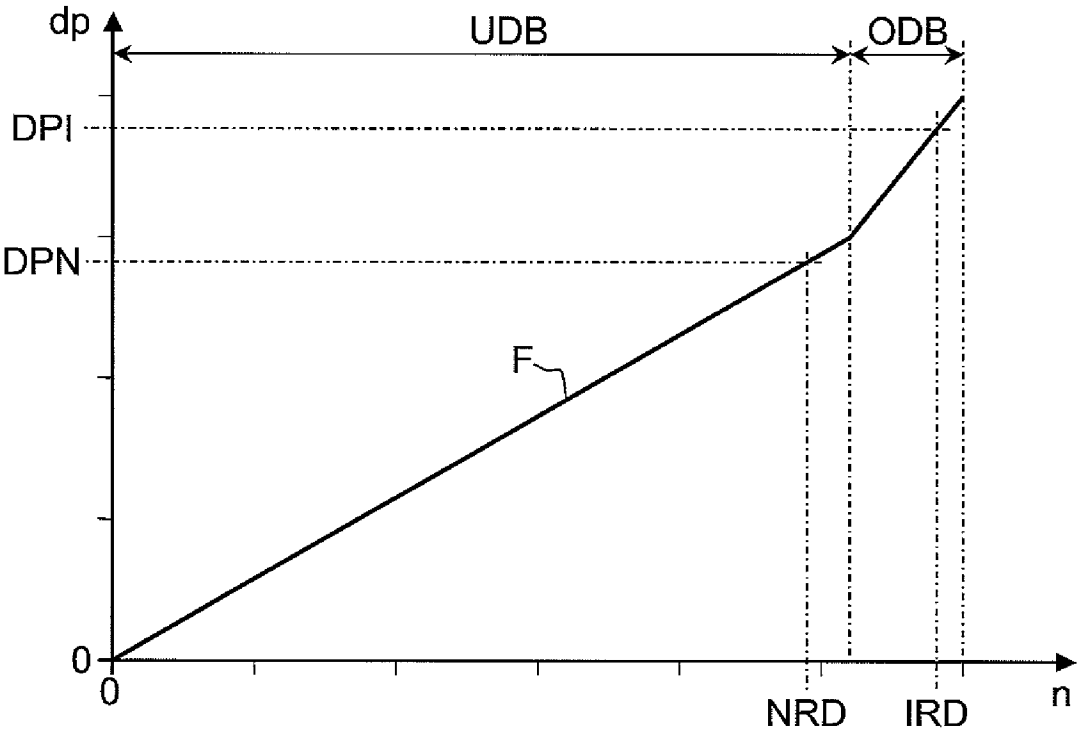
FIG. 3 shows a diagram for illustration of the pressure difference in the first spray element and in the second spray element in dependence on the rotational speed of the circulating pump of the household dishwasher of FIGS. 1 and 2.

FIG. 3 shows a diagram for illustration of the pressure difference dp in the first spray element 23 and in the second spray element 24 in dependence on the rotational speed n of the circulating pump 22 of the domestic dishwasher 1 of FIGS. 1 and 2. In that case, the rotational speed n of the circulating pump 22 is illustrated on the righthand abscissa axis and the pressure difference dp, which is defined as pressure of the rinsing liquid S in the second spray element 24 less the pressure of the rinsing liquid S in the first spray element 23, is illustrated on the vertical abscissa axis.

An idealised illustrated function F, which describes a pressure difference dp in dependence on the rotational speed n of the circulating pump 22, has a lower rotational speed range UDB in which the pressure difference dp changes at most proportionally to the rotational speed n of the circulating pump 22 and an upper rotational speed ODB in which the pressure difference dp changes more than proportionally to the rotational speed n of the circulating pump 22. A hydrostatic pressure difference which can arise due to an arrangement of the first spray element and the second spray element 24 is not in that case taken into consideration.

In the exemplifying embodiment the ratio of pressure difference dp and rotational speed n is constant in the lower rotational speed range UDB, i.e. pressure difference dp and rotational speed n behave substantially proportionally with respect to one another. The function F could, however, also run more flatly in the lower rotational speed range UDB, which would correspond with an under-proportional ratio of the pressure difference dp to the rotational speed n.

By contrast, in the upper rotational speed range ODB the function F runs more steeply than in the proportional case, for which reason reference here is to an over-proportional ratio of pressure difference dp to rotational speed n.

The plot of the function F is in that case determined by the constructional design of the duct system 25. In particular, the desired plot of the function F can be set by the different design of the first branch 25*a* of the duct system 25 and the second branch 25*b* of the duct system 25, wherein, in particular, use can be made of leakage points and/or constrictions 35 in the first branch 25*a*.

Insofar as in the dishwasher exemplifying embodiment rinsing stock of comparable kind and contamination is to be cleaned in the upper dishes basket 9 and at the same time lower dishes basket 10, a first rinsing program can be called up in which the circulating pump 22 is operated at a normal cleaning rotational speed NRD for normal cleaning of the rinsing stock. When, in particular, the normal cleaning rotational speed NRD lies in the lower rotational speed range UDB an almost comparable mechanical loading of the rinsing stock as well as an almost comparable cleaning action arises in the upper dishes basket 9 and the lower dishes basket 10 due to the relatively small pressure difference dp.

If now in the dishwasher of the exemplifying embodiment strongly contaminated rinsing stock is to be cleaned in the lower dishes basket 10 and at the same time sensitive rinsing stock in the upper dishes basket 9 then, for example, a second rinsing program provided as an intensive cleaning program can be selected by way of the operating device 3. In this second rinsing program the circulating pump 22 is operated at an intensive cleaning rotational speed IRD, which lies in the upper rotational speed range ODB and which is higher than the normal cleaning rotational speed NRD, for intensive cleaning of the rinsing stock. In this connection, due to the relatively large pressure difference dp in the lower dishes basket 10 a substantially higher cleaning action results without the mechanical loading of the rinsing stock in the upper dishes basket 9 increasing too much at the same time.

In this connection, in particular, it can be provided that the intensive cleaning rotational speed IRD is at least 2.5%, preferably at least 5%, particularly preferably at least 10%, higher than the normal cleaning rotational speed NRD. Equally, it is advantageous if the pressure difference DPI at the intensive cleaning rotational speed IDR is at least 5%, preferably at least 10%, particularly preferably at least 20%, higher than the pressure difference DPM at the normal cleaning rotational speed.

In an exemplifying embodiment of the invention the pressure in the hydraulic system 25 can be controlled by use of a circulating pump motor with rotational speed regulation. In that case, a special design of a supply path 25*a* of a spray plane can be provided which above a specific rotational speed of the circulating pump motor allows the losses (friction, resistance, leakage) to increase in such a manner that the pressure difference between the spray planes increases. There can now be selective action on the rinsing program by means of the parameters of circulating pump rotational speed, time and temperature in order to simultaneously clean sensitive and strongly contaminated rinsing stock in different rinsing planes. The pressure difference between the rinsing planes can rise more strongly from, for example, rotational speeds of about 2,900 rpm.

The dishwasher according to the invention is maintenance-free, non-susceptible to failure and economic.

The invention claimed is:

1. A dishwasher, comprising:

a control device to carry out a rinsing process for cleaning rinsing stock based on a rinsing program;

a rinsing chamber to receive the rinsing stock during the rinsing process;

a circulating pump to circulate a rinsing liquid present in the rinsing chamber, wherein a rotational speed of the circulating pump is variable by the control device;

a first spray element to apply the rinsing liquid on a first region of the rinsing chamber;

a second spray element to apply the rinsing liquid on a second region of the rinsing chamber; and a duct system to conduct the rinsing liquid from the circulating pump to the first spray element and the second spray element, the duct system having a first branch to conduct the rinsing liquid to the first spray element and a second branch to conduct the rinsing liquid to the second spray element;

wherein the duct system has a function, the function describing a pressure difference in dependence on the rotational speed of the circulating pump and having a lower rotational speed range in which the pressure difference changes at most in proportion to the rotational speed of the circulating pump and an upper rotational speed range in which the pressure difference changes more than in proportion to the rotational speed of the circulating pump, wherein the pressure difference is defined as a pressure of the rinsing liquid in the second spray element less a pressure of the rinsing liquid in the first spray element, the control device has a first rinsing program in which the circulating pump is operated at a normal cleaning rotational speed for normal cleaning of the rinsing stock and a second rinsing program in which the circulating pump is operated at an intensive cleaning rotational speed higher than the normal cleaning rotational speed and lying in the upper rotational speed range for intensive cleaning of the rinsing stock, the first spray element is a rotatable spray arm arranged at a rotary coupling, and the rotary coupling has a leakage point or the first branch includes a section having a constriction that has a fixed cross sectional area that is less than a cross sectional area of a remainder of the first branch and the constriction is not between the circulating pump and the second spray element.

2. The dishwasher of claim 1, wherein the dishwasher is a household dishwasher.

3. The dishwasher of claim 1, wherein the normal cleaning rotational speed lies in the lower rotational speed range.

4. The dishwasher of claim 1, wherein, when the dishwasher is in operation, the pressure difference is set exclusively by the control device by means of varying the rotational speed of the circulating pump.

5. The dishwasher of claim 1, wherein a pressure loss of the rinsing liquid due to leakage losses is higher in the first branch than in the second branch.

6. The dishwasher of claim 1, wherein a pressure loss of the rinsing liquid due to friction is higher in the first branch than in the second branch.

7. The dishwasher of claim 1, wherein the first branch has a greater length than the second branch.

8. The dishwasher of claim 1, wherein a dish basket to receive at least one of pans, pots, plates and items of cutlery is arranged in the second region of the rinsing chamber.

9. The dishwasher of claim 1, wherein a dish basket to receive at least one of glasses and cups is arranged in the first region of the rinsing chamber.

10. The dishwasher of claim 1, wherein the intensive cleaning rotational speed is at least 2.5% higher than the normal cleaning rotational speed.

11. The dishwasher of claim 10, wherein the intensive cleaning rotational speed is at least 5% higher than the normal cleaning rotational speed.

12. The dishwasher of claim 10, wherein the intensive cleaning rotational speed is at least 10% higher than the normal cleaning rotational speed.

13. The dishwasher of claim 1, wherein the pressure difference at the intensive cleaning rotational speed is at least 5% higher than the pressure difference at the normal cleaning rotational speed.

14. The dishwasher of claim 13, wherein the pressure difference at the intensive cleaning rotational speed is at least 10% higher than the pressure difference at the normal cleaning rotational speed.

15. The dishwasher of claim 13, wherein the pressure difference at the intensive cleaning rotational speed is at least 20% higher than the pressure difference at the normal cleaning rotational speed.

16. A dishwasher, comprising:

a control device to carry out a rinsing process for cleaning rinsing stock based on a rinsing program;

a rinsing chamber to receive the rinsing stock during the rinsing process;

a circulating pump to circulate a rinsing liquid present in the rinsing chamber, wherein a rotational speed of the circulating pump is variable by the control device;

a first spray element to apply the rinsing liquid on a first region of the rinsing chamber;

a second spray element to apply the rinsing liquid on a second region of the rinsing chamber; and a duct system to conduct the rinsing liquid from the circulating pump to the first spray element and the second spray element, the duct system having a first branch to conduct the rinsing liquid to the first spray element and a second branch to conduct the rinsing liquid to the second spray element;

wherein the duct system has a function, the function describing a pressure difference in dependence on the rotational speed of the circulating pump and having a lower rotational speed range in which the pressure difference changes at most in proportion to the rotational speed of the circulating pump and an upper rotational speed range in which the pressure difference changes more than in proportion to the rotational speed of the circulating pump, wherein the pressure difference is defined as a pressure of the rinsing liquid in the second spray element less a pressure of the rinsing liquid in the first spray element, the control device has a first rinsing program in which the circulating pump is operated at a normal cleaning rotational speed for normal cleaning of the rinsing stock and a second rinsing program in which the circulating pump is operated at an intensive cleaning rotational speed higher than the normal cleaning rotational speed and lying in the upper rotational speed range for intensive cleaning of the rinsing stock, and the first spray element is a rotatable spray arm arranged at a rotary coupling, the rotary coupling having a leakage point.

17. A method of operating a dishwasher having a control device to carry out a rinsing process for cleaning rinsing stock based on a rinsing program; a rinsing chamber to receive the rinsing stock during the rinsing process; a circulating pump to circulate a rinsing liquid present in the rinsing chamber, wherein a rotational speed of the circulating pump is variable by the control device; a first spray element to apply the rinsing liquid on a first region of the rinsing chamber, the first spray element being a rotatable spray arm arranged at a rotary coupling; a second spray element to apply the rinsing liquid on a second region of the rinsing chamber; and a duct system to conduct the rinsing liquid from the circulating pump to the first spray element and the second spray element, the duct system having a first branch to conduct the rinsing liquid to the first spray element and a second branch to conduct the rinsing liquid to the second spray element, wherein the duct system has a function, the function describing a pressure difference in dependence on the rotational speed of the circulating pump and having a lower rotational speed range in which the pressure difference changes at most in proportion to the rotational speed of the circulating pump and an upper rotational speed range in which the pressure difference changes more than in proportion to the rotational speed of the circulating pump, wherein the pressure difference is defined as a pressure of the rinsing liquid in the second spray element less a pressure of the rinsing liquid in the first spray element; the method comprising:

selecting, at the control device, one of a first rinsing program in which the circulating pump is operated at a normal cleaning rotational speed for normal cleaning of the rinsing stock and a second rinsing program in which the circulating pump is operated at an intensive cleaning rotational speed higher than the normal cleaning rotational speed and lying in the upper rotational speed range for intensive cleaning of the rinsing stock; and causing the function by providing the rotary coupling with a leakage point or providing the first branch with a section having a constriction that has a fixed cross sectional area that is less than a cross sectional area of a remainder of the first branch and the constriction is not between the circulating pump and the second spray element.

* * * * *